US006892903B1

(12) United States Patent
Bartolotta

(10) Patent No.: US 6,892,903 B1
(45) Date of Patent: May 17, 2005

(54) BOTTLED BEVERAGE DISPENSER

(76) Inventor: Salvatore Bartolotta, 2607 Harway Ave., Brooklyn, NY (US) 11214

( * ) Notice: Subject to any disclaimer, the term of this patent is extended or adjusted under 35 U.S.C. 154(b) by 121 days.

(21) Appl. No.: 10/358,659

(22) Filed: Feb. 5, 2003

Related U.S. Application Data

(60) Provisional application No. 60/355,291, filed on Feb. 9, 2002.

(51) Int. Cl.[7] ..... B67D 5/06
(52) U.S. Cl. ..... 222/185.1; 222/481.5
(58) Field of Search ..... 222/183, 185.1, 222/481.5

(56) References Cited

U.S. PATENT DOCUMENTS 4,928,855 A * 5/1990 Ramsey ..... 222/131
5,335,829 A * 8/1994 Sovann ..... 222/183
5,509,583 A * 4/1996 Dolson ..... 222/185.1
5,842,606 A * 12/1998 DeVito ..... 222/132
6,269,980 B1 * 8/2001 Randall et al. ..... 222/145.5
6,502,725 B1 * 1/2003 Alexander ..... 222/185.1
6,527,145 B1 * 3/2003 Bennett, Jr. ..... 222/185.1
6,540,111 B2 * 4/2003 Sunnarborg ..... 222/129

* cited by examiner

*Primary Examiner*—Joseph A Kaufman
(74) *Attorney, Agent, or Firm*—Goldstein Law Offices, P.C.

(57) ABSTRACT

A beverage dispenser, for mating with a bottle containing liquid contents and having a top, a mouth at the top, a bottom, and an upper portion. The dispenser includes a base having side walls, a top, and cradle and intermediate plates extending horizontally through the side walls. A pipe has an inlet end centrally located above the intermediate plate and having internal threading for accommodating and securing to the mouth of the bottle, and an outlet end extending horizontally from the base and having a spout. The cradle plate has a central opening which is substantially concentric with the inlet end and supports the bottle at its upper portion. The beverage dispenser is inverted to fasten the mouth of the bottle to the inlet end, and then is turned 'right-side-up' to invert the bottle, and allow the contents of the bottle to be easily dispensed through the spout.

7 Claims, 5 Drawing Sheets

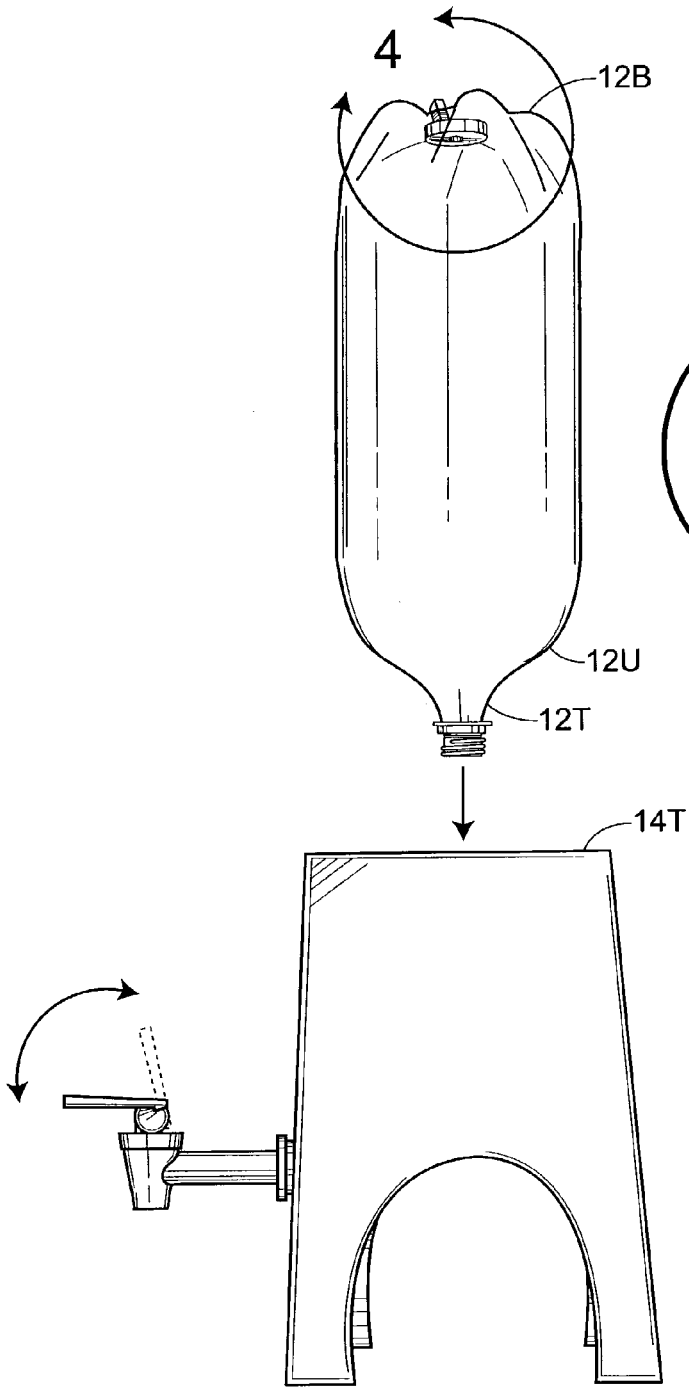
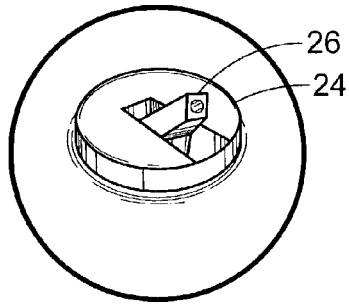
Fig. 4
Fig. 3

BOTTLED BEVERAGE DISPENSER

CROSS REFERENCES AND RELATED SUBJECT MATTER

The present application is a continuation-in-part of provisional patent application Ser. No. 60/355,291, filed in the United States Patent Office on Feb. 9, 2002.

BACKGROUND OF THE INVENTION

1. Field of the Invention

The invention relates to a bottled beverage dispenser. In particular, the invention is a beverage dispenser that is mated with an inverted bottle containing a beverage, to allow the beverage to be subsequently dispensed without actually handling the bottle.

2. Background

Many beverages, particularly sodas and other soft drinks, are sold in plastic bottles. The bottles are typically available in different sizes—the most popular being 2 liters. Because of the weight of these bottles, they are difficult for a child to maneuver. Spills often occur when a child tries to pour the contents from the bottle into a glass.

Even adults routinely encounter difficulty when attempting to pour a standard 2 liter soda bottle. Because of the diameter of the bottle, only the largest among us can 'palm' the bottle and pour it with one hand. Accordingly, pouring such bottles is typically a two-handed operation— especially when the bottle is nearly full. Such a two handed pour can be carried out without incident when pouring into a heavy container, such as a drinking glass. However, when one attempts to pour into an empty, lightweight paper or plastic drinking cup, there is a significant possibility that the weight of incoming stream of poured liquid will tip the cup. Further, when outdoors, often the wind will tip the cup or even carry it away before the poured beverage can properly ballast the cup. An adult is more likely to be embarrassed than a child when they create a spill while attempting to pour a beverage—and rightfully so!

Thus, there exists a need for a dispenser which is configured to accommodate a bottle containing a beverage, and allowing the same to be dispensed without handling the bottle, by a one handed operation that is simple enough for a child.

Over the years, others have proposed handles and various other pouring devices which seek to reduce spill messes. While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved beverage dispenser. As such, the general purpose of the present invention, which will be described subsequently in greater detail, is to provide a new and improved bottled beverage dispenser which has all the advantages of the prior art and none of the disadvantages.

It is an object of the invention to eliminate the need for a person to handle a beverage bottle in order to dispense the beverage. Accordingly, the dispenser of the present invention mates with the existing, externally threaded mouth of an inverted beverage bottle, and subsequently allows the beverage contained therein to be dispensed through an easily operable spout, while the beverage drains from the bottle through the existing mouth of said beverage bottle.

It is another object of the invention to allow the beverage to be dispensed as a one-handed operation. Accordingly, a simple spout is provided which allows the user to dispense the beverage by pressing a lever thereof. The dispenser and bottle have sufficient weight to ballast the dispenser upon an operating surface to allow such one-handed operation.

It is a further object of the invention to facilitate the smooth dispensing of the liquid. Thus, according to principles of fluid dynamics, air must enter the bottle for the fluid to drain therefrom. Although an inverted bottle will rapidly drain if held upside down over thin air, it does so in a rapid, turbulent, and messy fashion. However, to dispense the beverage in a smooth, controlled fashion, it is necessary to introduce air to replace the volume of liquid beverage leaving the bottle. To accomplish the same, the present invention sets forth several embodiments which have differing schemes for introducing air into the bottle. Among these, by a preferred embodiment, the dispenser is used with bottles having an air venting mechanism at the bottom of the bottle. Once installed in the dispenser and inverted, an air vent is opened to allow air to enter the bottle as the beverage leaves the spout. The air vent may be subsequently closed to allow the bottle to be removed from the dispenser prior to being fully emptied—so that the bottle can be once again refrigerated or otherwise stored in a non-inverted position.

To attain this, the present invention essentially comprises a beverage dispenser for accommodating an attachable beverage bottle having a top, a bottom, and an upper portion. The top of the bottle has an externally threaded mouth, liquid beverage held within the bottle being dispensed through the mouth. An air release mechanism is located at the bottom for allowing air to be infused into the bottle to allow an even flow of liquid out of the bottle. The base has a top surface and bottom. A circular opening is located on a cradle plate near the top surface of the base and is sized for accommodating and supporting the upper portion of the inverted bottle, while the bottom of the base rests upon an operating surface. A pipe has both inlet and outlet ends, the inlet end positioned within the base, and outlet end extending horizontally from the base. The inlet end has an internally threaded opening, oriented upward, and substantially concentric with the circular opening for receiving the threaded central aperture of the bottle when the bottle rests upon the circular opening. The pipe includes a right angle bend portion which orients the pipe toward one of the side walls such that the pipe extends through and externally beyond said side wall. A spout is located at the outlet end, external to the base and having a downwardly oriented spout opening located at a distance above the base bottom sufficient to allow a drinking glass to be inserted therebeneath on the operating surface. A valve lever on the spout gives the user selective control over the dispensing of liquid from the bottle through the spout opening.

It is a still further object of the invention to produce a beverage dispenser that easily supports the bottle when it is mated with the inlet. Accordingly, the circular opening is configured concentric with the inlet so that it can support the upper portion of the inverted bottle when the inlet mates with the mouth at the top of said bottle.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 3 is an exploded elevational view of the beverage dispenser and bottle, further illustrating operation of the valve lever of the spout.

FIG. 4 is an enlarged view of the air vent mechanism incorporated into a preferred embodiment of the invention, taken generally in the area indicated by circle 4 in FIG. 3.

REFERENCE NUMERALS

Figure 1:
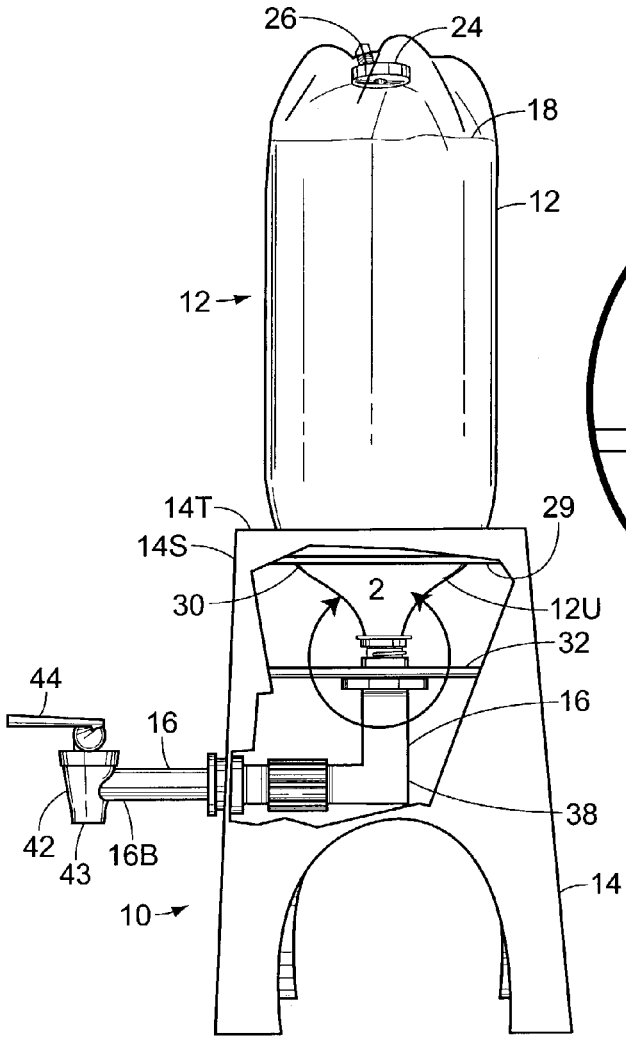
FIG. 1 is a side elevational view of the beverage dispenser, with a portion of one of the side walls of the base broken away to illustrate internal details of the dispenser, such that a beverage bottle is inverted and mated with the dispenser.

10 dispenser
12 beverage bottle
12T top of bottle
12U upper portion of bottle
12B bottom of bottle
14 dispenser base
14T top surface of base
14S side walls of base
16 pipe
16A inlet end of pipe
16B outlet end of pipe
18 liquid beverage
20 mouth of bottle
22 external threading of bottle mouth
24 air vent mechanism
26 flip-up air vent
28 legs of base
29 cradle plate
30 circular opening
32 intermediate plate
32B bottom surface of horizontal plate
34 central aperture in plate
36 internally threaded inlet
38 right angle bend portion
40 nut
42 spout
43 spout opening
44 spout valve lever
46 cover
46S cover sides
46T cover top
46B cover bottom edge
50 self venting spout
52 vent tube
54 vent tube opening
56 self venting spout air inlet.

DETAILED DESCRIPTION OF THE PREFERRED EMBODIMENTS

FIG. 1 illustrates a dispenser 10, for use with a beverage bottle 12 selectively attachable thereto such that the bottle 12 is supported by the dispenser 10 in an inverted position for dispensing liquid beverage 18 contained therein.

The bottle 12 is substantially shaped like a conventional soft drink bottle, namely a standard 2 liter soda bottle. Accordingly, the bottle 12 has a top 12T, a bottom 12B, and defines an interior volume for containing the liquid beverage 18. As illustrated in FIG. 1, the bottle 12 is mostly filled with liquid beverage 18. Better seen in FIG. 2, the top 12T has a mouth 20 with external threading 22 which normally accommodates a cap for sealing the bottle 12. The liquid 18 held within the bottle 12 is ordinarily dispensed through the mouth 20 once the cap has been removed by tilting the bottle and angling the mouth 20 downward. The bottle 12 has an upper portion 12U below the mouth 20 opposite from the top 12T and extending partially toward the bottom 12B. The upper portion 12U transitions from a smaller diameter at the mouth to a larger diameter when then remains substantially consistent to the bottom 12B.

The dispenser 10 essentially comprises a bottle supporting base 14, a pipe 16 having an inlet end 16A and an outlet end 16B, a spout 42 at the outlet end 16B, and an internally threaded inlet 36 at the inlet end 16A for mating with the mouth 20 of the bottle. The pipe 16 provides fluid communication between its inlet end 16A and outlet end 16B. The spout 42 has a downturned spout opening 43, and the internally threaded inlet 36 is upwardly oriented.

The base 14 has a top surface 14T which defines a ledge but is otherwise substantially open, and four side walls 14S extending downward therefrom. The base 14 facilitates the dispensing of liquid contents 18 of the bottle 12 by both holding the bottle 12 so that the user need not handle the same, and positioning the spout 42 for effective dispensing. Accordingly, the bottle supporting base 14 has four legs 28 extending downward from the side walls 14S to stably support said dispenser 10 upon an operative surface, which may be a table, a countertop, etc. In addition, the base 14 must suspend the spout 42 a distance above the operative surface which allows a drinking vessel, such as a drinking glass to be inserted beneath the spout opening 43. The spout 42 itself may be configured in a variety of ways. However, generally a tiltable lever 44 on the spout 42 is used to control the dispensing of liquid 18 from the bottle 12.

An intermediate plate 32 is positioned horizontally within the base 14, below yet near the top surface 14T, and extends substantially between at least two of the side walls 14S. The platform 32 has a central aperture 34. The inlet end 16A of the pipe 16 extends upward through the central aperture 34. A nut 40 extends around the pipe 16 immediately below the intermediate plate 32, along the bottom surface 32B thereof to fasten the pipe to the plate, and thereby lends support to the inlet end 16A of the pipe 16. When the bottle 12 is mated with the dispenser 10, the externally threaded mouth 20 is mated with the internally threaded inlet 36 within the inlet end 16A. Naturally then, a substantial portion of the weight of the bottle 12 is exerted upon the pipe 16 at the inlet end 16A. Preferably the inlet end 16A is also configured (with a flange or nut mating with or extending from the inlet end 16A above the intermediate plate) so as to help distribute weight exerted upon the inlet end upon the intermediate plate 32.

Immediately below the central aperture 34, the pipe has a right angle bend portion 38, such that the pipe 16 extends substantially vertically between the right angle bend portion 38 and the inlet end 16A, and substantially horizontally between the right angle bend portion 38 and the outlet end 16B. Accordingly, the pipe 16 extends horizontally below the intermediate plate 32, and exits the base 14 through one of the side walls 14S. The pipe 16 continues away from and external to the base 14, horizontally beyond said side wall 15S, to the spout 42 at the outlet end 16B. Hardware may also be provided at said side wall 14S, generally extending around the pipe 16, which fastens the pipe at said side wall 14S, and also helps support the weight of said pipe 16 thereat.

Figure 2:
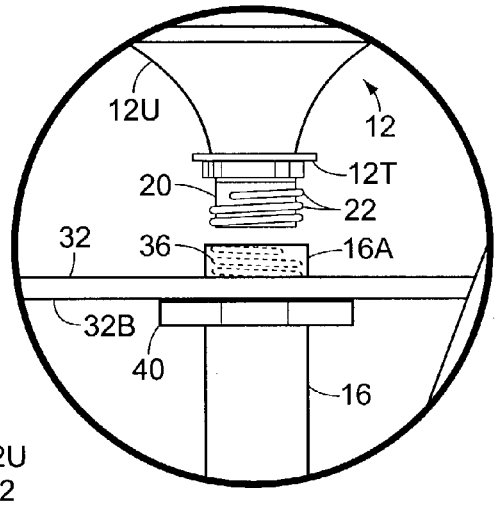
FIG. 2 is a diagrammatic enlargement of the portion indicated by circle 2 in FIG. 1, except wherein the mouth of the bottle is about to be mated with the inlet of the pipe.
Figure 5:
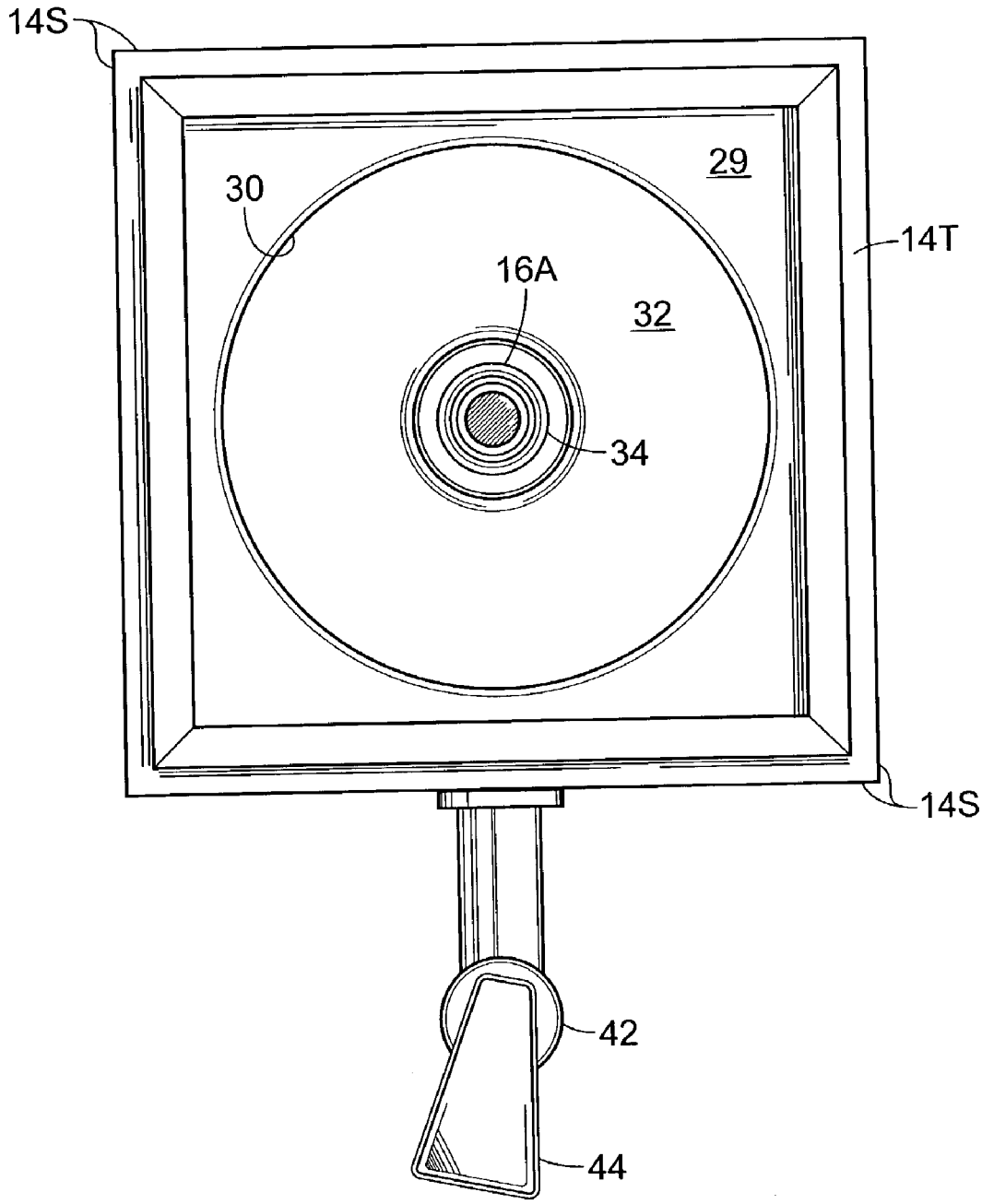
FIG. 5 is a top elevational view of the base, showing the circular opening within the cradle plate which cradles the upper portion of the bottle, and the inlet located concentrically therebelow.

A cradle plate 29 extends horizontally within the base 14 near the top surface 14T and has a circular opening 30 for accommodating the upper portion 12U of the bottle 12 when inverted, as illustrated in FIG. 2. It is preferable that most of the weight of the bottle is supported by the cradle plate 29, and that cradle plate 29 helps maintain the position of the bottle 12 and stabilizes the same. In this regard, typical beverage bottles 12, namely standard two liter bottles, transitionally increase in diameter at the upper portion 12U from an otherwise substantially consistent diameter below the upper portion 12U to the considerably smaller diameter at the mouth 20. When the bottle is inverted and extends downward into the base 14, the upper portion 12U of the bottle rests upon the cradle plate 29, with a portion of the bottle 12 including the top 12T of the bottle 12 extending below the cradle plate 29. Accordingly, the base 14 is configured so that when the mouth 20 of the bottle 12 is fully threaded into the inlet end 16A, the circular opening 30 is sized and positioned so as to meet the upper portion 12U of the bottle 12. In the case of standard two liter bottles, this positioning can be easily determined and fixed. To allow other bottles to be accommodated in this manner, the cradle plate may be made interchangeable, or may be adjustably mounted within the side walls 14S of the base, so that it can support the bottle, yet adjust in its relative position with respect to the inlet end 16A so that when the mouth 20 of other bottles are mated with the inlet end 16A, the upper end of said bottles will be similarly supported by the cradle plate 29. Such adjustability of the position of the cradle plate 29 may be accomplished with rigid springs extending between the cradle plate 29 and intermediate plate 32, which allow the cradle plate 29 to be pulled closer to the intermediate plate 32, and thus the inlet end 16A, as the mouth is fully threaded into inlet end 16A, but are sufficiently rigid to otherwise hold the bottle in a stable position over the intermediate plate 32.

Figure 6:
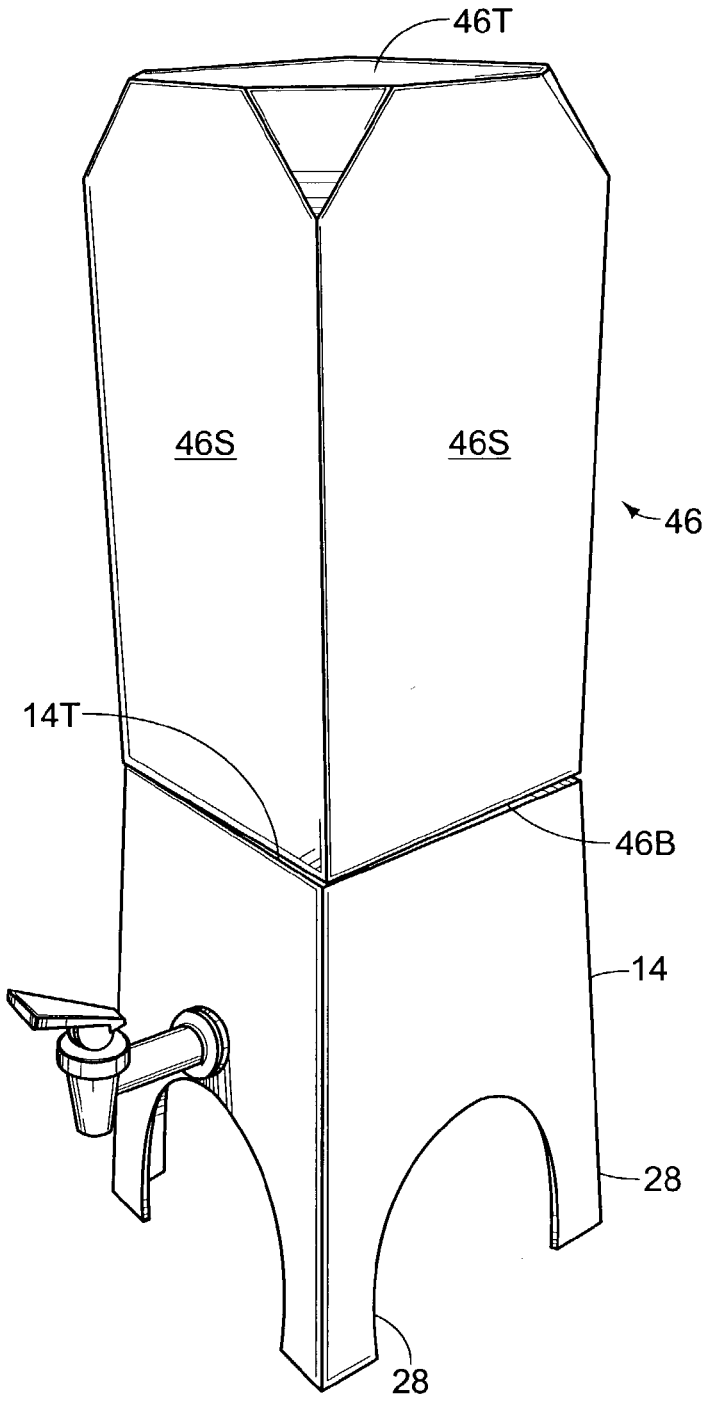
FIG. 6 is a perspective view of the beverage dispenser with the cover installed over the base, and also selectively over a bottle mated within the base.

A cover 46 is provided which is dimensionally configured to fit naturally on top of the base 14 to keep the inlet end 16A clean when not in use, and to conceal the bottle 12 when the bottle 12 is connected to the dispenser 10. The cover has a cover top 46T and four cover sides 46S which together define a cover interior. The cover 46 also has a cover bottom edge 46B which defines an opening to the interior of the cover 46 and selectively rests on the top surface 14T of the base 14, as illustrated in FIG. 6, such that the bottle 12 is allowed to extend within the cover interior. Accordingly, the cover sides 46S together have a similarly sized and shaped horizontal cross section as the base sides 14S taken together. The cover 46 may be constructed from an insulative material in order to keep the beverage contained within the bottle 12 at an optimum temperature for consumption.

In use, the dispenser 10 is inverted, the cap is removed from the bottle 12, and the mouth 20 of said bottle is inserted through the circular opening in the cradle and into the inlet end 16A of the pipe 16. The mouth 20 of the bottle 12 is threaded into the inlet end 16A, until secured tightly therein. Once the bottle 12 is securely fastened to the dispenser 10, the dispenser 10 is then turned right side up, and the bottle 12 is thereby inverted, with the bottom portion 12B of the bottle 12 oriented upward. The dispenser 10, its base 14, and the bottle 12 now mated therewith, is supported by its legs 28. The cover 46 may be placed over the bottle 12. A drinking cup (not shown) is then placed under the spout 42 and the contents of the bottle 12 are accessed by pressing upon the lever 44.

As previously noted, it is important to introduce air into the bottle 12 as the liquid contents 18 thereof are dispensed. The introduction of air into the bottle 12 may be accomplished in a variety of ways.

According to a preferred embodiment, an air venting mechanism 24 is located at or near the bottom 12B of the bottle, as illustrated in FIG. 4, to allow its use in conjunction with the dispenser 10 while ensuring the smooth dispensing of liquid beverage 18 through the spout 42. The venting mechanism 24 is selectively operable by the user to allow atmospheric air to enter the interior volume of the bottle 12 to replace the volume of liquid beverage 18 as it is dispensed from the bottle 12. While many forms of the venting mechanism 24 may be employed, the drawing figures illustrate a flip-up air vent 26 that is selectively openable by the user by simply pivoting the flip-up vent 26 by ninety degrees to open a passageway for allowing air to be introduced into the bottle 12 when liquid 18 is being dispensed therethrough, and is selectively closeable by pivoting the flip-up vent by ninety degrees so that it is substantially flush with the venting mechanism 24. According to this embodiment of the invention, beverage bottles 12 must have the venting mechanism for the dispenser 10 to function properly and dispense the liquid beverage 18 smoothly. The venting mechanism 24 should be configured while taking into consideration the pressurization of carbonated drinks which are commonly contained in the beverage bottles 12, such that the venting mechanism must be able to create an effective seal against internal pressures from such carbonated beverages. The actual venting mechanism 24 can be implemented in numerous ways that allow it to effectively allow or prevent gaseous communication between the bottle interior and the atmosphere. In addition, the venting mechanism 24 can employ a venting which allows air to enter, but does not allow liquid to exit. In general, however, the venting mechanism 24 must be closed if the bottle 12 is to be turned right-side-up before it is emptied of all liquid beverage 18 therein, such as when the bottle 12 is removed from the dispenser for refrigeration or storage.

Figure 7:
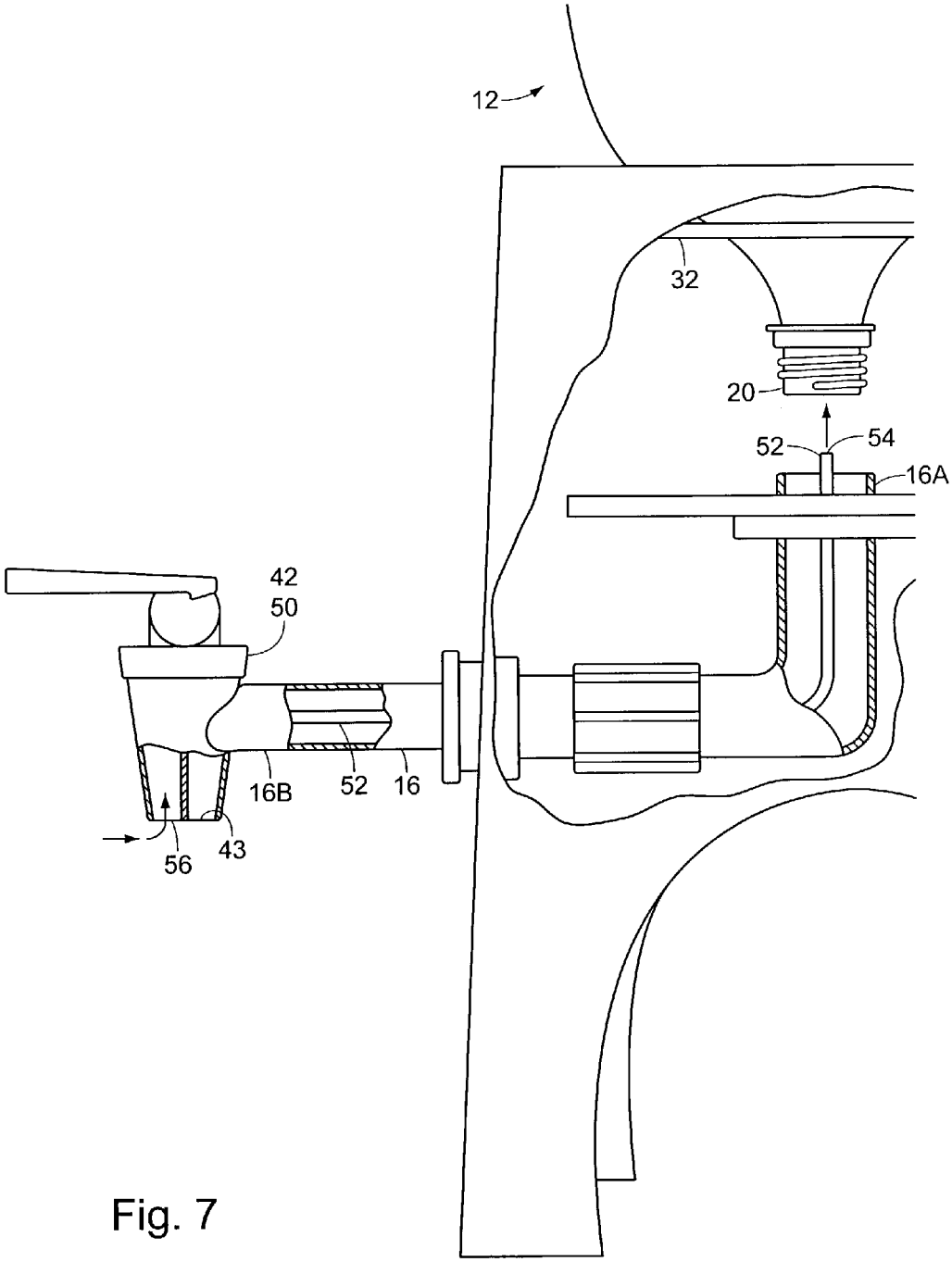
FIG. 7 is an enlarged side elevational view of a further embodiment of the invention, with parts broken away to illustrate a self venting spout and a vent tube extending axially through the pipe and exiting the inlet for extending partially into the bottle when mated with the inlet. Arrows indicate the path of air into the self venting spout and out through the vent tube opening for introducing air into the bottle when mated with the inlet.

FIG. 7 illustrates a further embodiment of the invention, wherein the spout 42 is a self-venting spout 50. Self venting spouts are sometimes used to dispense industrial chemicals from large (55 gallon) drums, which are otherwise sealed. According to this embodiment of the present invention, a vent tube 52 extends from the self-venting spout 50, substantially coaxially through the pipe 16, such that the vent tube extends upward through the inlet end 16A, and exits therefrom such that it extends slightly into the mouth 20 of the bottle 12, when mated with the inlet end 16A. A vent tube opening 54 is located on the vent tube 52 above the inlet end 16A and on a fully opposite end thereof from the self venting spout 50. The self venting spout 50 has a self venting spout air inlet 56, which may be located immediately adjacent to the spout opening 43. The self venting spout 50 is configured to convey air from the venting spout air inlet 56, through the vent tube 52 and into the bottle 12 through the vent tube opening 54, as indicated by the arrows in FIG. 7.

As previously noted, beyond the preferred embodiments described above, in meeting the other goals of the invention, other devices and techniques can be employed to vent the bottle to allow smooth dispensing of liquids therefrom. For example, if it is known that the liquid contents of the bottle will be fully consumed before removal from the dispenser, then the bottle may even be punctured by a needle valve or the like, when the cover 46 is lowered onto the base 14. Numerous other such devices and techniques would be known to those skilled in the art.

In conclusion, herein is presented a beverage dispenser which mates with a bottle, inverts the bottle, and then allows the contents of said bottle to be easily dispensed by using an easy to operate spout. The invention is illustrated by example in the drawing figures, and throughout the written description. It should be understood that numerous variations are possible, while adhering to the inventive concept. Such variations are contemplated as being a part of the present invention.

What is claimed is:

1. A dispenser, for mating with a bottle containing a liquid beverage, the bottle having a top, a bottom, an upper portion, and an externally threaded mouth, the bottle is a standard two-liter beverage bottle, which is of substantially consistent diameter from the bottom until the upper portion, and the bottle transitions in diameter at the upper portion to a considerably smaller diameter at the mouth, comprising:

a base having side walls and a top, the top substantially open, the base further having an intermediate plate extending horizontally between the side walls, the intermediate plate has a central opening, the base also having legs, extending downward from the side walls and away from the top, the legs for supporting the base upon an operative surface;

a pipe having an inlet end and an outlet end, the inlet end having an internally threaded inlet substantially centered within the base and oriented upward, the internally threaded inlet sized to mate with the externally threaded mouth of the bottle, the pipe has a right angle bend, such that the pipe extends vertically within the base between the inlet end and the right angle base, the pipe extends horizontally from the right angle bend, within the base, through one of the side walls, and then externally from the base;

a spout at the outlet end, external to the housing, the spout having a downturned spout opening, the spout operable by a user to selectively allow liquid beverage to be dispensed from the bottle, into the inlet end, and out through the spout; and a cradle plate, extending horizontally between the side walls of the base near the top of the base, the cradle plate having a circular opening substantially concentric with the inlet end of the pipe so that when the bottle is mated with the inlet end of the pipe, the upper portion of the bottle is supported by the cradle plate at the circular opening; and wherein the spacing of the inlet end and cradle plate circular opening is configured to accommodate and support the upper portion of the bottle when the mouth of said bottle is mated with the inlet end.

2. The dispenser as recited in claim 1, wherein the right angle bend is positioned below the intermediate plate such that the pipe extends horizontally below the intermediate plate, before extending horizontally out of the base through one of the side walls.

3. The dispenser as recited in claim 2, further comprising a cover, having sides, a top, and a bottom edge, the cover open at the bottom edge, the cover sized to rest upon the base with the bottom edge of the cover upon the top edge of the base, to cover the bottle when mated to the base.

4. The dispenser as recited in claim 3, wherein the spout is a self-venting spout, having a vent tube extending from the spout, through the pipe, and out through the inlet end, so that when the inlet end is attached to the mouth of a bottle, the vent tube extends into the bottle and communicates air from the self-venting spout into the bottle.

5. A dispenser system, comprising:

a plurality of bottles, each containing a liquid beverage, each bottle having a top, a bottom, an upper portion, and an externally threaded mouth, each bottle is a standard two-liter beverage bottle, which is of substantially consistent diameter from the bottom until the upper portion, and the bottle transitions in diameter at the upper portion to a considerably smaller diameter at the mouth, each bottle also having an air vent located at the bottom, the vent selectively openable when the bottle is inverted to allow air to enter the bottle; and a dispenser unit, for mating with the bottles, the dispenser having:

a base having side walls and a top, the top substantially open, the base having legs extending downward from the side walls and away from the top, the legs for supporting the base upon an operative surface and providing space to allow the liquid beverage to be dispensed into a drinking cup, the base further has an intermediate plate extending horizontally between the side walls, the intermediate plate has a central opening, a pipe having an inlet end and an outlet end, the inlet end having an internally threaded inlet substantially centered within the base and oriented upward, the inlet end extending upwardly through the central opening of the intermediate plate and fastened thereto, the internally threaded inlet sized to mate with the externally threaded mouth of the bottle, the pipe has a right angle bend, such that the pipe extends vertically within the base between the inlet end and the right angle base, the pipe also extends horizontally from the right angle bend, within the base, through one of the side walls, and then externally from the base, a spout at the outlet end, external to the housing, the spout having a downturned spout opening, the spout operable by a user to selectively allow liquid beverage to be dispensed from the bottle, into the inlet end, and out through the spout, and a cradle plate, extending horizontally between the side walls of the base near the top of the base, the cradle plate having a circular opening substantially concentric with the inlet end of the pipe so that when the bottle is mated with the inlet end of the pipe, the upper portion of the bottle is supported by the cradle plate at the circular opening, wherein the spacing of the inlet end and cradle plate circular opening is configured to accommodate and support the upper portion of the bottle when the mouth of said bottle is mated with the inlet end.

6. The dispenser as recited in claim 5, wherein the right angle bend is positioned below the intermediate plate such that the pipe extends horizontally below the intermediate plate, before extending horizontally out of the base through one of the side walls.

7. The dispenser as recited in claim 6, further comprising a cover, having sides, a top, and a bottom edge, the cover open at the bottom edge, the cover sized to rest upon the base with the bottom edge of the cover upon the top edge of the base, to cover the bottle when mated to the base.

* * * * *